US006283403B1

(12) United States Patent
Braun et al.

(10) Patent No.: US 6,283,403 B1
(45) Date of Patent: Sep. 4, 2001

(54) STRIP WINDER

(75) Inventors: Martin Braun, Kreuztal; Reinhard Irle, Hilchenbach; Adolf Müller, Wilnsdorf, all of (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/485,747

(22) PCT Filed: Aug. 13, 1997

(86) PCT No.: PCT/PE98/05151

§ 371 Date: Feb. 15, 2000

§ 102(e) Date: Feb. 15, 2000

(87) PCT Pub. No.: WO99/08814

PCT Pub. Date: Feb. 25, 1999

(30) Foreign Application Priority Data

| | | |
|---|---|---|
| Aug. 15, 1997 | (DE) | 197 36 260 |
| Mar. 9, 1998 | (DE) | 198 09 810 |
| Aug. 10, 1998 | (DE) | 198 36 177 |

(51) Int. Cl.[7] ..... B65H 18/04; B65H 19/28

(52) U.S. Cl. ..... 242/532.2; 242/542.2; 242/547

(58) Field of Search ..... 242/532.2, 532, 242/547, 542.2; 72/148

(56) References Cited

U.S. PATENT DOCUMENTS

| | | | | |
|---|---|---|---|---|
| 3,100,605 | * | 8/1963 | Bond | 242/532 |
| 4,964,587 | * | 10/1990 | Oki et al. | 242/532 |

FOREIGN PATENT DOCUMENTS

| | | |
|---|---|---|
| 3708891 | 11/1987 | (DE) . |
| 867086 | 5/1961 | (GB) . |
| 2096973 | 10/1982 | (GB) . |

OTHER PUBLICATIONS

Patent Abstracts of Japan, vol. 008, No. 064 (M–285), Mar. 27, 1984 & JP 8 215220 A (Kawasaki Seitetsu KK), Dec. 14, 1983.

* cited by examiner

*Primary Examiner*—John M. Jillions
(74) *Attorney, Agent, or Firm*—Friedrich Kueffner

(57) ABSTRACT

The invention relates to a strip winder (1) for winding a hot or cold strip (25) into a coil, comprising a winder mandrel (2), pressure rolls (6–8) which can be in the form of comb rolls (6'–8') deflection cups (9–11), and a feed shaft (20). The aim of the invention is to improve a strip winder of this type so that a hot or cold strip (25) can be wound securely on the winder mandrel (2) even at high speeds and when the strip is thin. To that end, the deflection cups (9–11) have channels (18) whose outlet openings (19) are located in the cup area and the channels (18) are connected to a medium supply system.

2 Claims, 2 Drawing Sheets

STRIP WINDER

Figure 1:
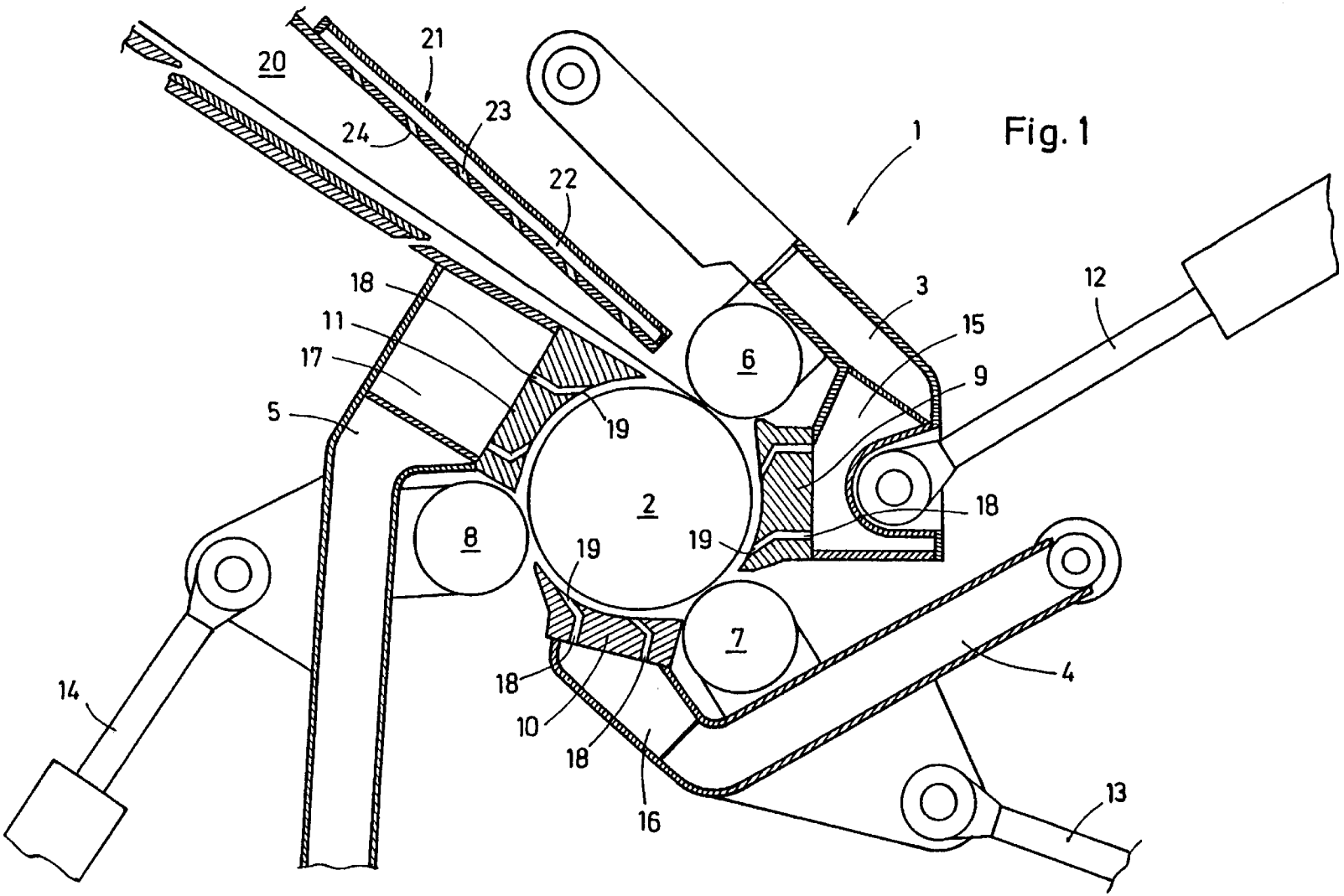

The invention relates to a strip winder for winding hot or cold strip to a coil, comprising pressure rolls, deflection cups, and a feed shaft.

In such strip winders the pressure rolls are driven and positioned together with the deflection cups on pivot systems which are moved by hydraulic or pneumatic cylinders and are supported so as to be pivotable about a pivot point such that they are movable toward and away from the winder mandrel. The pressure rolls and deflection cups serve to guide the first windings of the strip to be wound about the winder mandrel and, in combination with expanding of the winder mandrel, provide the frictional connection between the strip and the winder mandrel, while subsequently the strip is wound under tension with the pressure rolls and deflection cups pivoted away. The pressure rolls also have the task to secure the outer winding at the end of the winding process.

The strip to be deflected by the deflection cups is forced into the curved contour of the deflection cup because of centrifugal forces and lateral power. This results in a frictional force which provides resistance to the transport movement of the strip. This frictional force, especially for thin strips because of their minimal buckle resistance, can cause the strip to buckle and get stuck between the winding mandrel and the deflection cups within the winder, thus forcing the winding process to be interrupted.

In order to overcome these disadvantages, JP 58 215 220 A and GB 867 086 A suggest to provide the deflection cups with channels having outlet openings in the cup area and to connect the channels to a medium supply system. This achieves that the strip to be wound can no longer be damaged within the area of the deflection cups. However, in the area of the feed shaft and of the pressure rolls, there is still the possibility of damage to the strip.

The invention therefore has the object to design a strip winder such that beginning of winding of a hot or cold strip onto the winder mandrel can be securely performed also at greater velocities and small thickness.

To this end, it is suggested that the pressure rolls are embodied as comb rolls, the outlet openings of the channels are aligned with the comb gaps of the comb rolls positioned downstream in the strip transport direction, and pressure medium is supplied via the comb gaps to the deflection cups positioned downstream in the strip transport direction.

For this purpose, it is suggested to provide the deflection cups with channels having outlet openings within the cup area and to connect the channels to a medium supply system.

The exiting medium provides a reduction of the frictional force between strip and cup during the deflection of the strip. It exerts forces onto the strip, whose components act in the direction of strip movement as well as toward the winder mandrel. Accordingly, the strip is guided onto the spreading winder mandrel. Moreover, the strip is forwardly transported by the driven pressure rolls against which it rests under frictional force so that breaking out of the strip is prevented. At the end of the winding process the outer winding of the coil is forced by the pressure rolls onto the coil wherein the pressure rolls are driven at a slightly lower velocity than the strip transport velocity and thus prevents flapping of the strip end about the coil.

The medium with which the channels of the deflection cups are to be supplied can be water or compressed air. When the medium supply is provided for multiple channels, it is sufficient to provide a flexible line extending thereto which can compensate for the pivot movement of the cups.

Moreover, it has been found to be advantageous when the pressure rolls are comb rolls, the outlet openings of the channels are aligned with the comb gaps of the comb rolls positioned downstream in the strip transport direction, and pressure medium is supplied via the comb gaps to the deflection cups positioned downstream in the strip transport direction.

In this way, the complete deflection cup arranged downstream is flooded with pressure medium so that the leading strip end, which is forced by centrifugal forces against the cups, is entrained and the strip is thus kept away from the deflection cups.

In order to ensure the safe transport of the incoming band within the winder, it is furthermore suggested to connect the shaft flap, and possibly also other parts of the winder feed shaft to the medium supply system and to allow the medium to flow through the openings in the guide surfaces onto the incoming strip to thereby reduce friction and to ensure safe transport.

Figure 2:
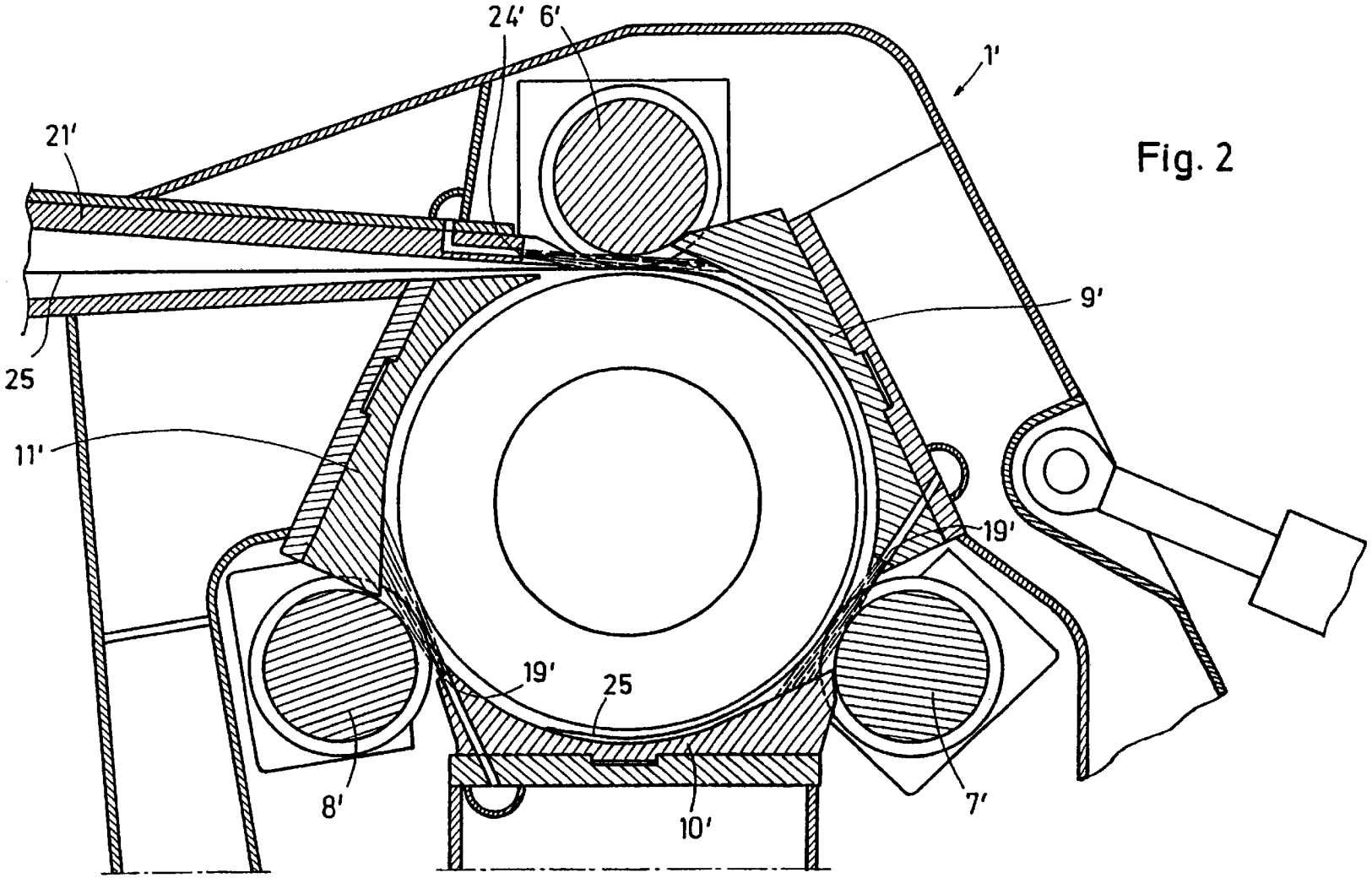

The invention will be explained in more detail with the aid of a drawing. It is shown in:

FIG. 1 a schematic and sectional representation of the inventive strip winder, and FIG. 2 the inventive strip winder with comb rolls.

FIG. 1 shows the winder 1 which is comprised of a winder mandrel 2 having correlated therewith pressure rolls 6, 7, 8 connected to support arms 3, 4, 5, wherein the support arms 3, 4, 5 furthermore have deflection cups 9, 10, 11. The support arms 3, 4, 5 are pivotably driven by piston-cylinder-units 12, 13, 14 about pivot points toward the winder mandrel 2, respectively, away from it.

The support arms 3, 4, 5 are hollow and have pressure chambers 15, 16, 17 for the medium, for example, water or compressed air. Channels 18 extend from the pressure chambers 15, 16, 17 into the deflection cups 9, 10, 11 and end in outlet openings 19 located at the surface of the deflection cups 9, 10, 11, facing the winder mandrel 2. The outlet openings 19 are directed in the strip transport direction and also toward the winder mandrel 2. Because of the deflection cups 9, 10, 11 being loaded by the medium, the strip (not shown) transported between the winder mandrel 2 and the pressure rolls 6, 7, 8 can be forced away from the deflection cups 9, 10, 11 against the winder mandrel 2.

In the feed shaft 20 via which the strip (not shown) is fed to the winder 1, the shaft flap 21 has a pressure chamber 22 from which channels 23 extend toward outlet openings 24 via which the medium can be forced against the incoming strip for guiding purposes.

FIG. 2 shows a winder 1' in which the pressure rolls 6', 7', 8' are embodied as comb rolls. The medium is sprayed via the outlet openings 19' of the deflection cups 9', 10', 11', respectively, via the outlet opening 24' of the shaft flap 21' through the gaps of the comb rolls onto the next deflection cup 9', 10', 11' in the transport direction so that the deflection cups 9', 10', 11' are completely loaded by the medium and thus keep the strip 25 entering the winder 1' away from the deflection cups 9', 10', 11' in an optimal fashion.

Overview of Reference Numerals

1 winder
2 winder mandrel
3 support arm
4 support arm
5 support arm
6 pressure roll
7 pressure roll
8 pressure roll

9 deflection cup
10 deflection cup
11 deflection cup
12 piston-cylinder-unit
13 piston-cylinder-unit
14 piston-cylinder-unit
15 pressure chamber
16 pressure chamber
17 pressure chamber
18 channel
19 outlet opening
20 feed shaft
21 shaft flap
22 pressure chamber
23 channel
24 outlet opening
25 strip

What is claimed is:

1. Strip winder (1) for winding hot or cold strip (25) to a coil, comprising a winder mandrel (2) as well as pressure rolls (6, 7, 8), deflection cups (9, 10, 11), and a feed shaft (20), wherein the deflection cups (9, 10, 11) have channels (18) having outlet openings (19) within the cup area, wherein the channels (18) and their openings (19) are arranged in the transport direction of the strip to be wound, and wherein the channels (18) are connected to a medium supply system, wherein the pressure rolls (6', 7', 8') are embodied as comb rolls, that the outlet openings (19',24') of the channels (18', 23') are aligned with the comb gaps of the comb rolls arranged downstream in the strip transport direction, and that the pressure medium is supplied via the comb gaps to the deflection cups (9', 10', 11') arranged downstream in the strip transport direction.

2. Strip winder according to claim 1, wherein the feed shaft (20) is formed on one side by a shaft flap (21), which has a pressure chamber (22) with channels (23) extending therefrom and with outlet openings (24), wherein the pressure chamber (22) is connected to the medium supply system.

* * * * *